United States Patent [19]

Duncan

[11] Patent Number: 4,490,874

[45] Date of Patent: Jan. 1, 1985

[54] BRUSH CONTROL MEANS

[75] Inventor: Ian J. Duncan, Cambridge, England

[73] Assignee: Schmidt Manufacturing & Equipment (UK) Ltd., Cambridgeshire, England

[21] Appl. No.: 469,589

[22] Filed: Feb. 25, 1983

[30] Foreign Application Priority Data

Feb. 27, 1982 [GB] United Kingdom ..... 8205869

[51] Int. Cl.[3] ..... E01H 1/04

[52] U.S. Cl. ..... 15/87

[58] Field of Search ..... 15/83–87, 15/340

[56] References Cited

U.S. PATENT DOCUMENTS 3,790,981 2/1974 Young ..... 15/87

FOREIGN PATENT DOCUMENTS 1911932 10/1969 Fed. Rep. of Germany ..... 15/87

*Primary Examiner*—Edward I. Roberts

*Attorney, Agent, or Firm*—Watson, Cole, Grindle & Watson

[57] ABSTRACT

Brush control means for controlling the operative position of the rotary brushes of a road or like sweeping machine comprises an electronic control unit operated by a driver's controller for controlling the operation of a valve, which in turn controls the operation of a hydraulic ram connected to the brush mounting for angularly moving the latter laterally about its pivotal mounting on the machine. A sensor such as a linear transducer operated by the ram is responsive to the operative position of the brush mounting as selected by the control unit for operating the valve to hold the ram against operation and hence the brush mounting against outward lateral movement from the selected position. Yieldable continuous low pressure operation of the brush mounting in the outward direction is preferably provided whereby the mounting is able to yield inwardly when the brush encounters an obstacle such as a curb. The brush mounting may be also protected by a fender arranged to operate a sensor or switch for effecting operation of the valve through the control unit for causing the ram to move the mounting in negotiating an obstacle. A further sensor may similarly effect ram operation of the brush mounting in response to operation of the steering gear of the machine.

10 Claims, 5 Drawing Figures

BRUSH CONTROL MEANS

BACKGROUND OF THE INVENTION

This is directed to a means for controlling the operative position of a rotary brush or brushes of a machine for sweeping roads, pavements or similar surfaces in which the or each such brush, when in its operative position, is rotatable about a substantially vertical axis. In particular, this invention is directed to a means, operable by the driver, for controlling the position of the brushes to suit varying conditions of use.

SUMMARY OF THE INVENTION

According to this invention brush control means for controlling the operative position of a rotary brush or each brush of a said sweeping machine basically comprises operable control means for controlling the operation of operating means for moving the rotary brush mounting laterally about pivotal mounting thereof from the machine, and sensing means which is responsive to the operative position of the brush mounting as selected by the control means and through the latter effects holding of the operating means against operation and hence the brush mounting against at least outward lateral movement from the selected operative position.

BRIEF DESCRIPTION OF THE DRAWINGS

Practical examples of the invention are shown in the accompanying drawings in which.

Like parts are referred to by the same or similar reference numerals throughout the drawings while any values are quoted by way of practical example only and may be varied according to requirements.

DESCRIPTION OF PRACTICAL EMBODIMENTS

Figure 1:
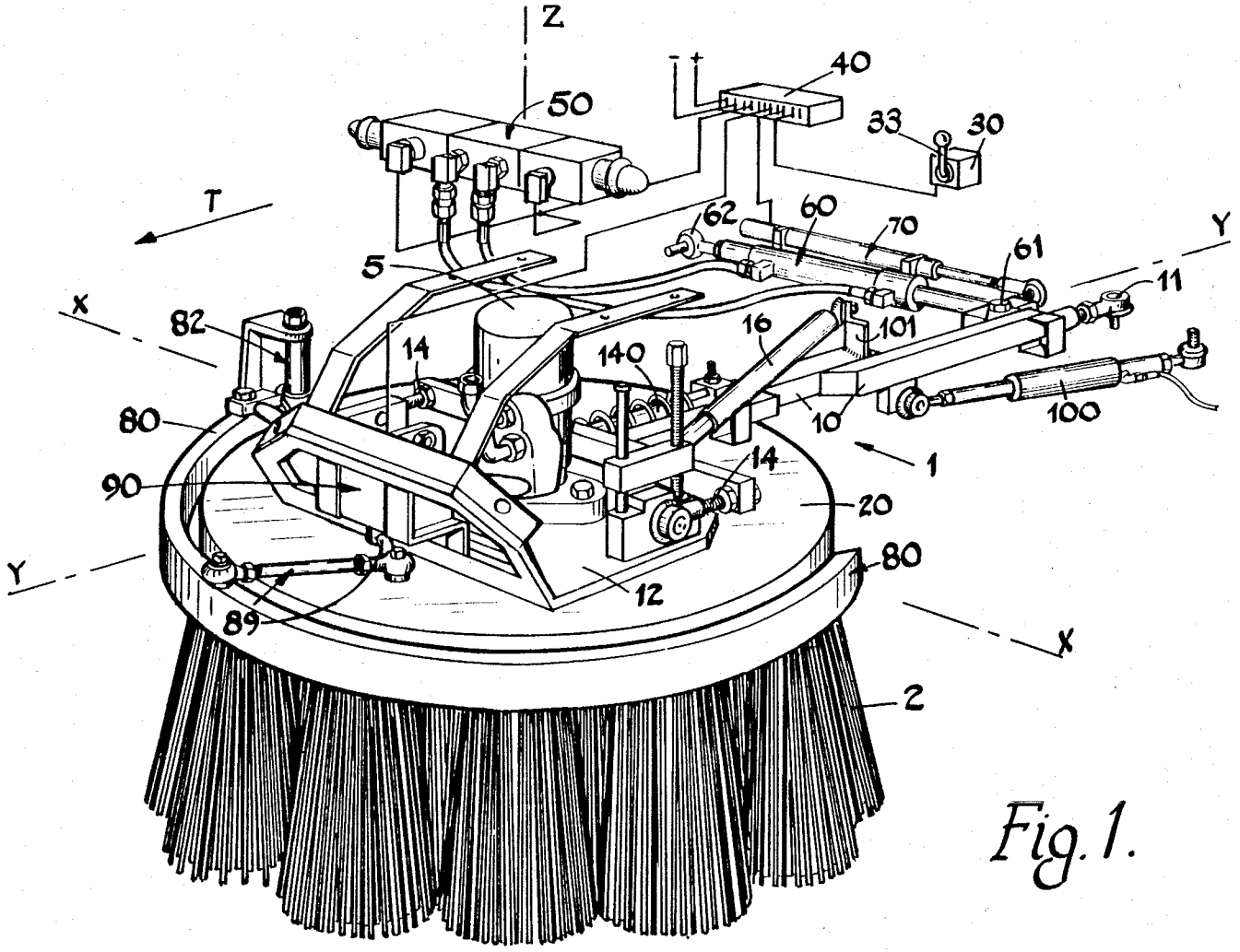
FIG. 1 is a schematic front perspective view of the brush mounting and control means.

In a known manner the brush mounting 1 consists of a swing arm 10 pivotally mounted at 11 from bracket or other support structure (not shown) of the machine, which arm 10 is usually forwardly extending in the general longitudinal direction T of travelling movement of the sweeping machine.

A support member 12 for the brush 2 is pivotally mounted for forward and backward inclination about a transverse X axis by fork structure 14 which in turn is pivotally carried by a shaft 140 journalled in the arm 10 for side inclination of the brush 2 about the longitudinal Y axis. Movement about these axes is shown damped by spring and/or fluid pressure-actuated damping means such as the damper or gas spring 16 connected between a bracket 101 on the arm 10 and the fork structure 14. Such pivotal movement may be also limited by stop means, especially about the Y axis.

The X and Y axes intersect at right angles to one another and also preferably intersect the generally vertical axis Z of the brush 2 and the hydraulic or other driving motor 5 mounted on the support member 12 for direct drive of the rotary brush 2.

The damper or gas spring 16 serves to yieldably maintain the brush 2 at the appropriate sweeping angle about the axes X and Y, e.g., for gulley sweeping.

In accordance with this invention a machine driver's control means 30, which has a stay-put action and which may consist of a rotary potentiometer electrically connected to an electronic control unit, 40 is provided for in turn controlling the operation of a solenoid-operated spool type valve 50 for admitting hydraulic or other fluid under pressure to a double acting ram 60, which is pivotally anchored at one end at 62 to support structure from the vehicle and at the other end is pivotally connected at 61 to a rear part of the swing arm 10. Thus, operation of the lever 33 of the control means 30 by the machine driver at the driving position of the sweeping machine causes the ram 60 to be operated to swing the arm 10 outwardly or inwardly according to the required operative position of the brush 2 as preselected by the control means 30.

When the brush reaches the required position, a sensor 70, shown in the form of a linear transducer alongside the ram 60 and linearly operated by direct connection to the latter feeds a control signal back to the electronic control unit 40. When the signal matches that provided by the control means 30, the valve 50 is operated or shut to retain hydraulic fluid in the cylinder of the ram 60, and so causes the arm 10 and the brush 2 to be held in the pre-determined lateral position, preferably with provision for yielding movement as referred to below.

By appropriate operation of the control means 30 this operative position can be varied at will by the driver to meet varying conditions of use as they are encountered, especially in following a gulley or curb.

Where the sweeping machine is provided with two brushes, i.e., at the left and right at the front of the machine, separate control means 30 for each brush 2 is provided at the driving position for independent positional control of the brushes.

Figure 4:
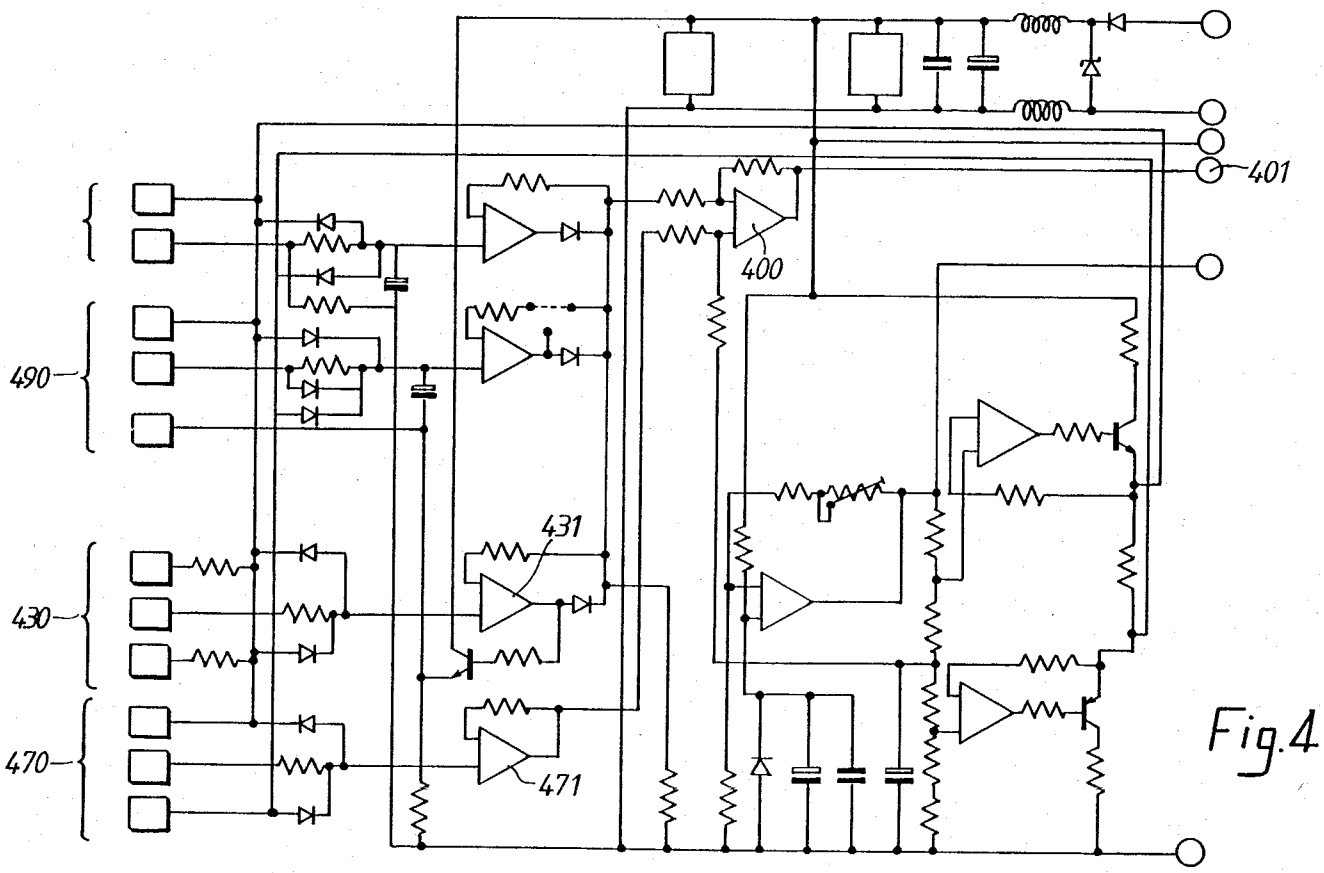
FIGS. 4 and 5 show control circuit diagrams.
Figure 5:
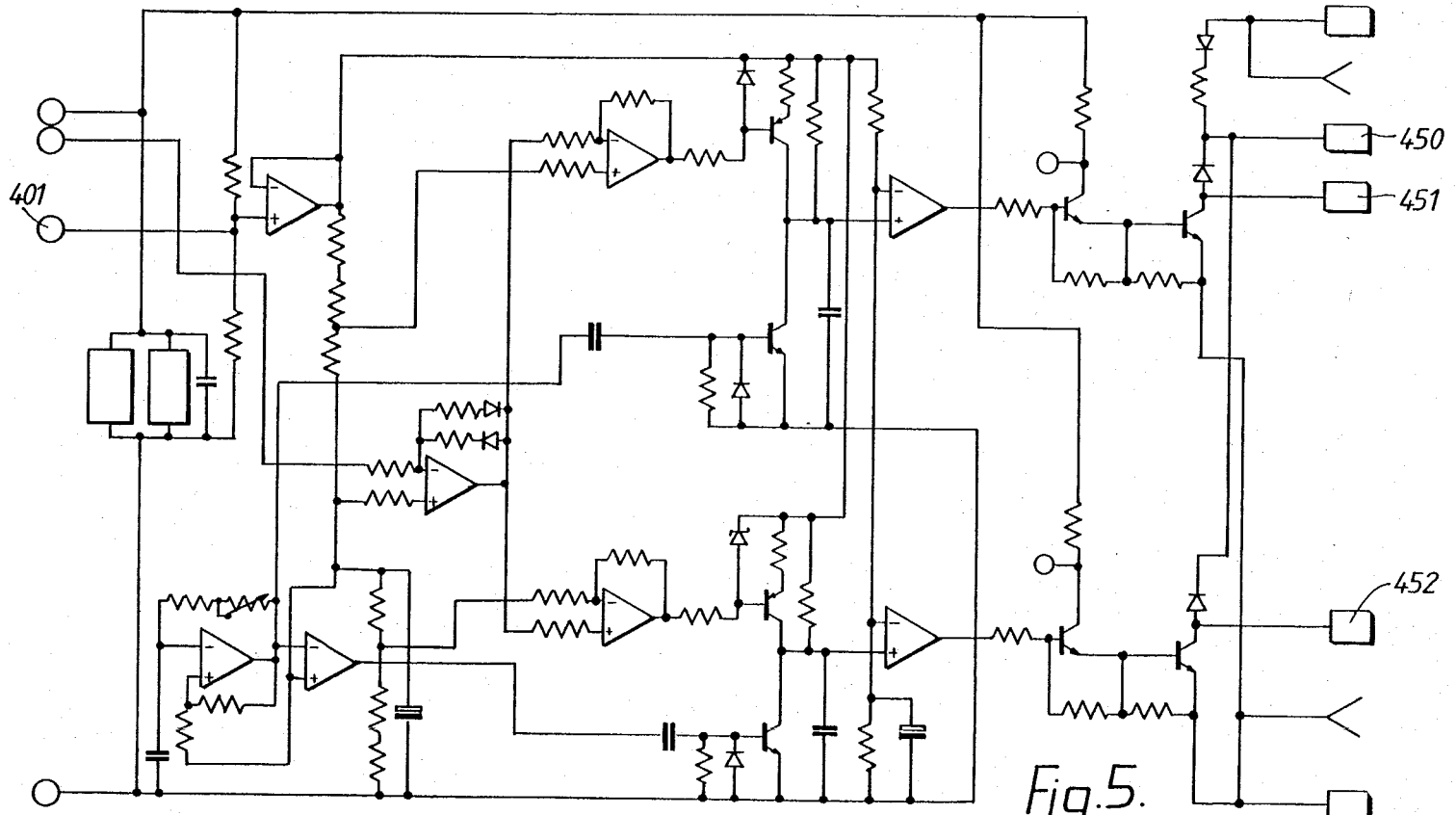

Diagrams of the circuit boards of the control unit 40 are shown in FIGS. 4 and 5 in which a signal from the machine driver's controller 30 is input at 430 into the first section of the circuit (FIG. 4) together with feed back input from the transducer 70 at 470. After buffering of such signal inputs at 431 and 471 and their comparison or matching at 400 the resulting output at 401 passes to the second or signal conditioning section of the circuit (FIG. 5) for subsequent outputs at 450, 451 and 452 to the solenoids of the hydraulic valve 50 for appropriate controlled operation of the latter.

Figure 3:
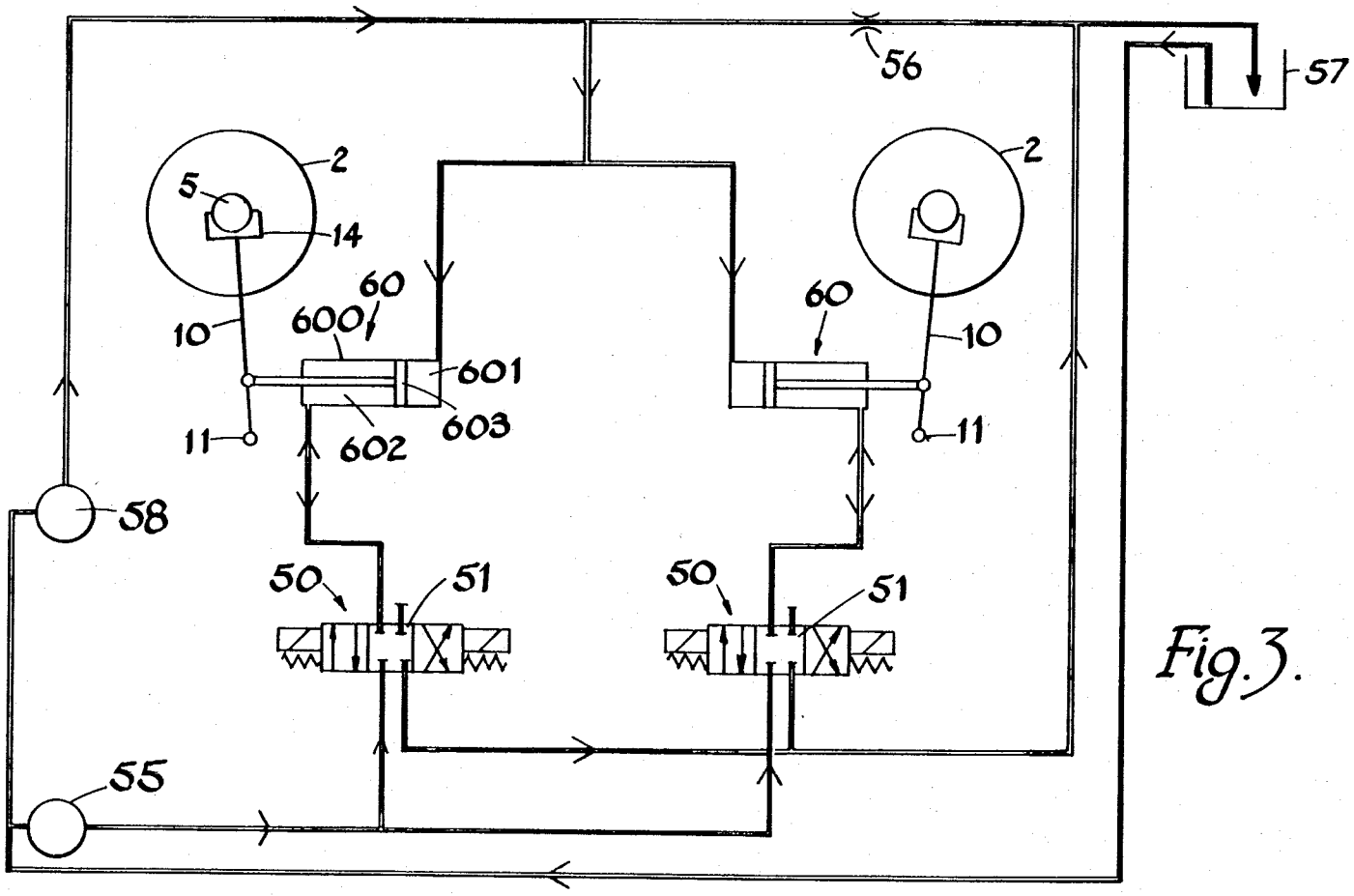
FIG. 3 is a hydraulic circuit diagram.

The arrangement is preferably such that the brush 2 is able to yield inwardly from its pre-determined lateral position, i.e., in the event of the brush striking or running against an obstacle such as curb, and for this purpose the hydraulic operation of the or each ram 60 is as shown in FIG. 3 in which hydraulic fluid under pressure is supplied by a pump 55 to each valve 50 for controlled operation of the rams 60. In addition, an auxiliary supply at 58 of fluid under pressure is effected via a restrictor 56 to a reservoir 57 and which continuously provides a low pressure differential (e.g., 2.5 bar) in the system, and fluid at this pressure is also supplied to the cylinder 600 of each ram 60 at 601 in order to continuously urge the piston 603 and associated brush 2 outwardly. Due to this low pressure operation the action is such that either of the brushes 2 is able to yieldably move inwardly on encountering an obstacle and returns to the pre-determined position when such deflecting contact no longer occurs. Thus, operative positioning of the brushes especially for gulley or similar cleaning is effectively maintained.

The required position of each brush 2 is determined by the operation of the corresponding valve 50. Thus, on operation of the spool 51 of the valve 50 to the right as seen in FIG. 3, fluid is directed to the ram cylinder 600 at 602 which moves the piston 603 inwardly, overcoming the low pressure acting on it in the opposite direction. When the spool 51 returns to the central or shut off position, (i.e., when the signal from the transducer 70 matches that from the control means 30) fluid supplied to the cylinder 600 at 602 is retained or locked therein, preventing outward movement of the brush 2 beyond the pre-determined position. Movement of the spool 51 to the left enables fluid to be exhausted from the cylinder 600 at 602 to the reservoir 57 in permitting outward movement of the piston 603 and brush 2 by the low pressure operation.

Operation of each valve 50 by the control means 30, control unit 40 and transducer 70 thus determines the operative position of the associated brush 2 in a self-setting manner against the yielding or cushioning action of the low pressure fluid acting on the piston 603 of the ram 60.

In addition to the above-described yielding action of each brush 2, and in the event of an obstacle being encountered in the path of travel of the brush which is in a higher position than the top of a normal curb and likely to cause damage to the brush 2 and/or mounting 1, there is provided, in accordance with a further feature of this invention, a feeler or nudge bar 80 shown extending in a substantially semi-circular manner about the brush 2 or brush head 20.

The feeler bar 80 is pivotally mounted at 82 about a vertical axis from the brush support member 12 so that, on the bar 80 striking an obstacle, it turns about its pivotal mounting 82. Through inter-connecting linkage 89 this causes a sensor 90 to be actuated to send a signal to the electronic unit 40, which in turn sends a signal to the hydraulic control valve 50 for effecting operation of the ram 60 to swing the arm 10 and hence the brush 2 laterally until the obstacle is cleared or negotiated. An alternative arrangement for this purpose is later described with reference to FIG. 2.

In addition to the ready manner in which the position of the brush 2 can be controlled for an effective or optimum sweeping action, the brush 2 and brush mounting 1 are automatically safeguarded against damage, especially in the event of failure to operate the control means 30 to avoid an obstacle or incorrect operation of the control.

The brush 2 and mounting 1 can be raised to an inoperative position by a ram 100 connected between the swing arm 10 and support structure of the vehicle, which ram 100 is operated by control means (not shown) at the driving position for raising and lowering the brush 2 in this way.

Figure 2:
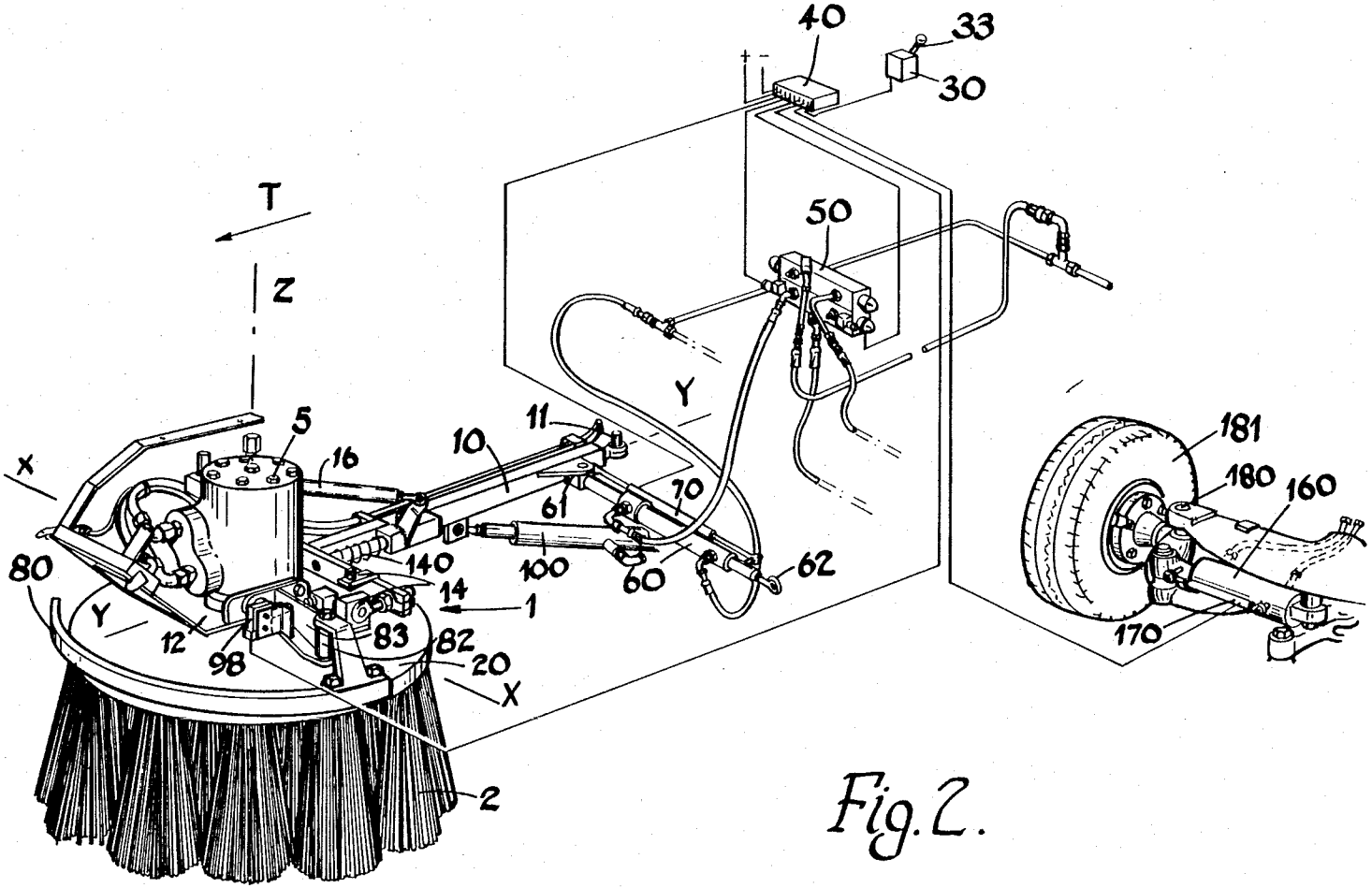
FIG. 2 is a perspective view similar to FIG. 1 but showing modifications.

Referring to FIG. 2 the arrangement is generally the same as that already described with reference to FIG. 1 and the same reference numerals and letters apply.

However, instead of a sensor 90, a switch such as a micro switch 98 is provided and operated by an arm 83 fast with the pivotally mounted feeler bar 80. When the bar 80 strikes or runs against an obstacle, the arm 83 is swung to operate, or permit operation, of the micro switch 98 so as to transmits a signal to the control unit 40 for appropriate operation of the arm 10 by the ram 60.

The feeler bar 80 is shown of shorter extent than that of FIG. 1 to avoid undesired operation, e.g., by a high curb.

A further development is also shown in FIG. 2 in which required positioning of the or each brush 2 (especially the nearside brush) is obtained as the sweeping machine turns a corner. Positioning of the brush 2 in this way is controlled by the steering gear of the machine, and in the example shown a sensor such as a linear transducer 170 is provided alongside and directly connected to an operating ram 160 for the swivel or king pin mounting 180 of a steerable road wheel 181 of the machine. The transducer 170 transmits an appropriate signal to the control unit 40 on steering movement of the wheel 181 or of each such wheel for angular operation of the arm 10 by the ram 60 to position the brush 2 accordingly, e.g., through an arc proportional to the steering angle.

The movement of the brush 2 or brushes in this way may vary in a simple or complex relationship relative to the steering angle, depending on the control parameters and required geometric relationship. A sensor or transducer for this purpose may be operated by any suitable part of the steering gear.

I claim:

1. Brush control means for controlling the operative position of at least one rotary brush of a sweeping machine for sweeping road, pavement and similar surfaces and wherein the brush is rotatable about a substantially vertical axis comprising (a) a rotary brush mounting arm pivotably mountable from the machine for lateral angular movement about such pivotal mounting;

(b) an electronic control unit;

(c) machine driver's electric control means electrically connected to the electronic control unit for controlling said electronic control unit;

(d) a solenoid-operated pressurized fluid directional flow control valve in circuit with said electronic control unit for control of the operation of the valve by said electronic control unit;

(e) a fluid pressure-operated ram controlled by said valve and mechanically connected to the rotary brush mounting arm for angularly moving it laterally about its pivotal mounting; and (f) a sensor electrically connected to the electronic control unit and mechanically connected to the rotary brush mounting arm so as to be responsive to the operative position of said arm as selected by machine driver's control of said electronic control unit, said sensor being arranged to effect feed back control of the electronic control unit for in turn causing the latter to control the solenoid-operated valve for holding the ram against operation and hence the rotary brush mounting arm against at least outward lateral angular movement from the said selected operative position.

2. Brush control means according to claim 1 wherein the machine driver's control means is arranged to control the electronic control unit by signal input to the latter and the sensor is arranged to effect feed back signal input to the electronic control unit whereby, on said signal inputs matching, the solenoid-operated valve is controlled by the electronic control unit to hold the ram against said operation.

3. Brush control means according to claim 1 wherein the machine driver's control means comprises a rotary potentiometer.

4. Brush control means according to claim 1 wherein the sensor comprises a linear transducer mechanically connected to the ram and hence to the rotary brush mounting arm for linear operation by the ram so as to be responsive to the operative position of the rotary brush mounting arm.

5. Brush control means according to claim 1 wherein the rotary brush mounting arm is angularly movable inwardly in relation to the machine against yieldable means urging the rotary brush mounting arm outwardly relative to the machine and against the action of the ram, whereby the rotary brush mounting arm is able to yield inwardly on the brush encountering an obstacle such as a curb.

6. Brush control means according to claim 5 wherein yieldable means is provided by ram means arranged to operate under continuous low fluid pressure for effecting operation of the rotary brush mounting arm for outward lateral movement thereof.

7. Brush control means according to claim 6 wherein the low fluid pressure ram means is also provided by the brush mounting arm operating ram in which the piston of the latter is arranged to receive, acting on one side thereof, fluid under operating pressure from the solenoid-operated valve and is further arranged to receive a continuous supply of fluid at relatively low pressure acting on the other side thereof.

8. Brush control means according to claim 1 wherein a fender is provided around the rotary brush and is movably carried by support of the rotary brush on the mounting arm for the operation of sensing means in the event of the fender encountering an obstacle, which sensing means is electrically connected to the electronic control unit and is arranged to cause, through the latter, operation of the solenoid-operated valve for effecting operation of the ram to angularly move the rotary brush mounting arm laterally in order to clear or negotiate the obstacle.

9. Brush control means according to claim 1 wherein a fender is provided around the rotary brush and is movably carried by support of the rotary brush on the mounting arm for the operation of switch means in the event of the fender encountering an obstacle, which switch means is electrically connected to the electronic control unit and is arranged to cause, through the latter, operation of the solenoid-operated valve for effecting operation of the ram to angularly move the rotary brush mounting arm laterally in order to clear or negotiate the obstacle.

10. Brush control means according to claim 1 wherein further sensing means is provided mechanically connectible to the steering gear of the sweeping machine so as to be responsive to steering movement thereof and electrically connected to the electronic control means for causing the latter to control the solenoid-operated valve for operation of the ram to angularly move the rotary brush mounting arm accordingly, e.g., through an arc proportional to the steering angle or in other relationship thereto.

* * * * *